US006021772A

United States Patent [19]

Seifert et al.

[11] Patent Number: 6,021,772

[45] Date of Patent: Feb. 8, 2000

[54] BANDSAW AND PROCESS FOR CUTTING OFF SLICES FROM A WORKPIECE

[75] Inventors: Dieter Seifert, Neuoetting; Klemens Muehlbauer, Burgkirchen, both of Germany

[73] Assignee: Wacker Siltronic Gesellschaft für Halbleitermaterialien AG, Burghausen, Germany

[21] Appl. No.: 09/039,049

[22] Filed: Mar. 13, 1998

[30] Foreign Application Priority Data

| | | | |
|---|---|---|---|
| Mar. 21, 1997 | [DE] | Germany | 197 11 913 |
| Aug. 7, 1997 | [DE] | Germany | 197 34 243 |

[51] Int. Cl.[7] ..... B28D 2/04

[52] U.S. Cl. ..... 125/13.02; 83/820; 83/824; 83/100

[58] Field of Search ..... 125/13.01, 13.02; 83/820, 824, 100

[56] References Cited

U.S. PATENT DOCUMENTS

| | | | |
|---|---|---|---|
| 3,592,094 | 7/1971 | Greenblatt | 83/201 |
| 3,889,564 | 6/1975 | Aspinwall et al. | 83/788 |
| 3,908,501 | 9/1975 | Aizawa | 83/788 |
| 3,913,436 | 10/1975 | Orescan | 83/409 |
| 4,165,663 | 8/1979 | Tsutsui et al. | 83/416 |
| 4,222,295 | 9/1980 | Sawamura | 83/169 |
| 4,355,555 | 10/1982 | Kobayashi et al. | 83/62.1 |
| 4,896,459 | 1/1990 | Brandt | 51/5 C |
| 5,472,262 | 12/1995 | Buyens et al. | 299/15 |
| 5,626,066 | 5/1997 | Lallement | 83/451 |
| 5,732,610 | 3/1998 | Halladay et al. | 83/871 |

FOREIGN PATENT DOCUMENTS

| | | |
|---|---|---|
| 1569176 | 5/1969 | France . |
| 3613132 | 10/1987 | Germany . |
| 60-29208 | 7/1983 | Japan . |

OTHER PUBLICATIONS

Ullmann's Encyclopedia of Industrial Chemistry VCH VeHagsgesellschaft Weinheim 1993.

Dubbel, Taschenbuch für den Maschinenbaun, Springer–Verlag Berlin, 18, Auflage.

*Primary Examiner*—Joseph J. Hail, III
*Assistant Examiner*—Dermott J. Cooke
*Attorney, Agent, or Firm*—Collard & Roe, PC

[57] ABSTRACT

A bandsaw for cutting off slices from a workpiece includes a sawband which circulates over a system of pulleys and has a band back and a cutting edge, which is situated opposite to the band back and is provided with a cutting surface. There is also a feed system, which effects a relative movement between the workpiece and the cutting edge, so that the sawband penetrates into the workpiece, thus forming a cutting gap. The bandsaw has a support plate, which supports the band back and is held by a holding device. There is also a process for cutting off slices from a workpiece using this bandsaw. A part of the support plate, which part adjoins the band back, also penetrates into the cutting gap during the cutting of the workpiece.

21 Claims, 3 Drawing Sheets

BANDSAW AND PROCESS FOR CUTTING OFF SLICES FROM A WORKPIECE

BACKGROUND OF THE INVENTION

1. Field of the Invention

The present invention relates to a bandsaw for cutting off slices from a workpiece, comprising a sawband which rotates over a system of pulleys and has a band back and a cutting edge. This cutting edge is situated opposite to the band back and is provided with a cutting surface. There is also a feed system for providing a relative movement between a workpiece and the cutting edge. Thus, as the sawband penetrates into the workpiece, a cutting gap is formed.

The present invention also relates to a process for cutting off slices from a workpiece, and in particular for cutting off semiconductor wafers, using this bandsaw.

2. The Prior Art

Rods or blocks of semiconductor material, such as for example silicon, are sliced into wafer-like units on an industrial scale. These units are predominantly needed as base material for the production of electronic components. Annular saws, frame saws and wire saws are usually used for cutting off slices from such workpieces. Bandsaws are also used, but only for dividing up large cast ingots by individual cuts, and for cutting off endpieces of crystals. Annular saws and wire saws are described in the chapter entitled "*Silicon*" in Vol. A23 of *Ullmann's Encyclopedia of Industrial Chemistry*, VCH Verlagsgesellschaft Weinheim 1993, on pages 734, 735, 739 and 740. A description of bandsawing can be found, for example, in *Dubbel, Taschenbuch für den Maschinenbau* [*Handbook for Machine Construction*], Springer-Verlag Berlin, 18th Edition, pages T87 and T88.

Wire saws are currently used predominantly for the production of semiconductor wafers with relatively large diameters of 200 and 300 mm. This is because the waste when using wire saws is lower than the waste created when using annular saws. On the other hand, the use of annular saws has the advantage over the use of wire saws that the end of the workpiece can be machined before the cutting operation. Consequently, the semiconductor wafer produced after the cutting operation has a reference plane for further material-abrading machining steps. This machining of the end of the workpiece is described, for example, in DE-3613132 A1. Since bandsawing is a method in which semiconductor wafers can be produced sequentially, this is similar to annular sawing. Thus, the advantage of machining the end of the workpiece can also be utilized in conjunction with bandsawing. Because of the high cutting forces which arise when cutting off semiconductor wafers using a bandsaw, it has hitherto been necessary to use sawbands which have a relatively large cross-section. However, these sawbands cause a high level of waste, making it uneconomical to slice off semiconductor wafers using bandsaws. Very thin sawbands, which could be used to reduce the waste, have only a low degree of strength. This low strength is a disadvantage for producing precise cutting at a high feed rate, which is economically necessary.

SUMMARY OF THE INVENTION

It is an object of the present invention to provide a bandsaw which is particularly suitable for cutting off semiconductor wafers and to provide a cutting process using a bandsaw which will solve the above-mentioned problems.

The present invention is directed to a bandsaw for cutting off slices from a workpiece, said bandsaw comprising a system of pulleys; a sawband which circulates over said system of pulleys and said sawband having a band back and a cutting edge, which cutting edge is situated opposite to the band back and is provided with a cutting surface; a feed system for effecting a relative movement between a workpiece and the cutting edge; a cutting gap having a width and formed by the sawband penetrating into the workpiece; a support plate for supporting the band back of the sawband; and a holding device for holding the support plate.

The present invention is also directed to a process for cutting off slices from a workpiece using a bandsaw with a circulating sawband and said sawband having a band back and having a cutting edge with a cutting surface comprising the steps of using said bandsaw for circulating said sawband for causing said cutting edge to penetrate into said workpiece for cutting a cutting gap within said workpiece; supporting the circulating sawband back by a support plate; and having a part of the support plate which part is supporting the band back, also penetrating into the cutting gap.

The support plate, which also penetrates at least partially into the cutting gap, stabilizes the sawband. Thus, it is possible to use even sawbands with a small cross-sectional thickness; and thus the waste material produced can be kept to a minimum amount. The support plate furthermore makes it possible to hold the sawband in the planned cutting plane, so that a cutting path which is as planar as possible is achieved. The support plate moreover makes it possible to operate at high feed rates which further improve the economic efficiency of the process.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
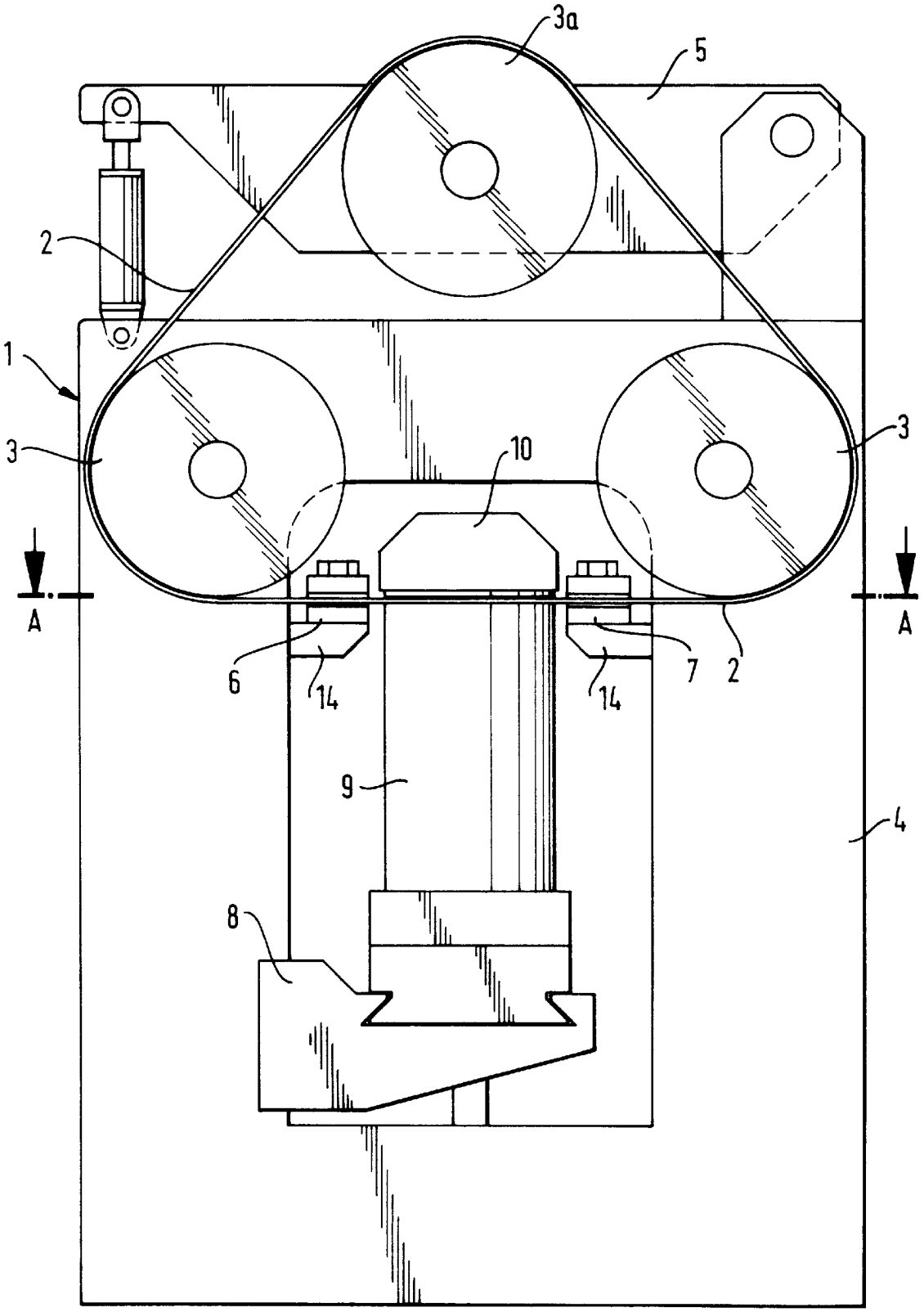
FIG. 1 shows a front view of a bandsaw according to the invention.

Turning now in detail to the drawings, FIG. 1 is taken as the initial reference point. This figure illustrates a preferred embodiment of a bandsaw 1 of the invention. The sawband 2 of the bandsaw is guided over three deflection pulleys 3 with horizontal axes. At least one of the deflection pulleys, for example, the deflection pulley 3*a*, is driven, for example, by an electric motor. All three of these pulleys are mounted in a machine frame 4. It is desirable for at least one of the deflection pulleys to be a tensioning pulley which can be displaceably mounted. Thus, the sawband can be tensioned and relaxed by means of a corresponding movement of the tensioning pulley. The deflection pulley 3*a* is consequently shown as mounted on an adjustable rocker arm 5.

The band path can be influenced and stabilized by means of guides which are located at the sides of the workpiece. Useful as guides, for example, are additional guide pulleys (not shown). With the aid of these guides, the sawband can be moved perpendicular to the running direction or the sawband can be tilted out of its current running plane. The bandsaw illustrated in FIG. 1 is equipped with guides 6 and 7, between which the sawband runs. In order to influence the band path, the sawband may be subjected to the action of a fluid stream, for example of water and/or air. This fluid stream will operate in accordance with hydrostatic or hydrodynamic flow principles, or aerostatic or aerodynamic flow principles. To achieve this result, feed ducts are provided in the jaws of the guides, with outlet openings pointing in the direction of the sawband. Also the guide surfaces of the jaws are of a corresponding construction (not shown). In the event of a deviation from the planned cutting path, which is recorded by sensors, the position of the band is altered. This altering occurs due to the asymmetric application of the fluid stream to the sawband; and the band path is corrected in the desired manner. Controlling the position of the band by applying a fluid stream to the sawband can be effected both in the guides and in the cutting gap.

The bandsaw furthermore comprises a feed system 8, on which is mounted a cylindrical workpiece 9 with an essentially perpendicular axis. The workpiece is guided linearly towards the cutting edge of the sawband. The shape of the workpiece and the number of workpieces which are mounted on the feed system may differ from the details given. It is also possible for the feed system to be constructed in such a way that the workpiece is guided towards the cutting edge of the sawband with a pivoting movement. It is also possible for a rotary movement to be superimposed on the feed movement. Also it is possible for the workpiece to remain stationary and for the sawband to be moved towards the workpiece. In any case, the feed system effects a relative movement between workpiece and cutting edge.

The bandsaw shown in FIG. 1 may also be constructed as a horizontal structure. This structure is produced, for example, if FIG. 1 is interpreted as a plan view of the bandsaw; and the feed system 8 is assumed to be arranged beneath the deflection pulleys 3. This structure with vertically aligned deflection pulleys has particular advantages. It is possible to achieve a low structural height for the bandsaw. Also the slurry produced when cutting off wafers can be removed more completely by the sawband from the cutting gap. This is due to its own weight which means that the slurry remains in the lower region of the saw gap. An arrangement of the deflection pulley axes and of the feed which is inclined with respect to the vertical (e.g. by 30°) is also suitable for this purpose. This arrangement may be advantageous to achieve the desired structural height and accessibility.

It is preferred to provide a movable wafer holder 10 above the workpiece. This wafer holder supports the wafer to be cut off on that side of the wafer which is opposite from the sawband. The wafer holder 10 is placed on the workpiece 9 and is preferably joined to the workpiece by a vacuum holding action. During the cutting operation, the holder moves together with the workpiece. The holder can then be moved away from the workpiece in order to remove the sliced wafer and to place the sliced wafer in a different location.

Figure 2:
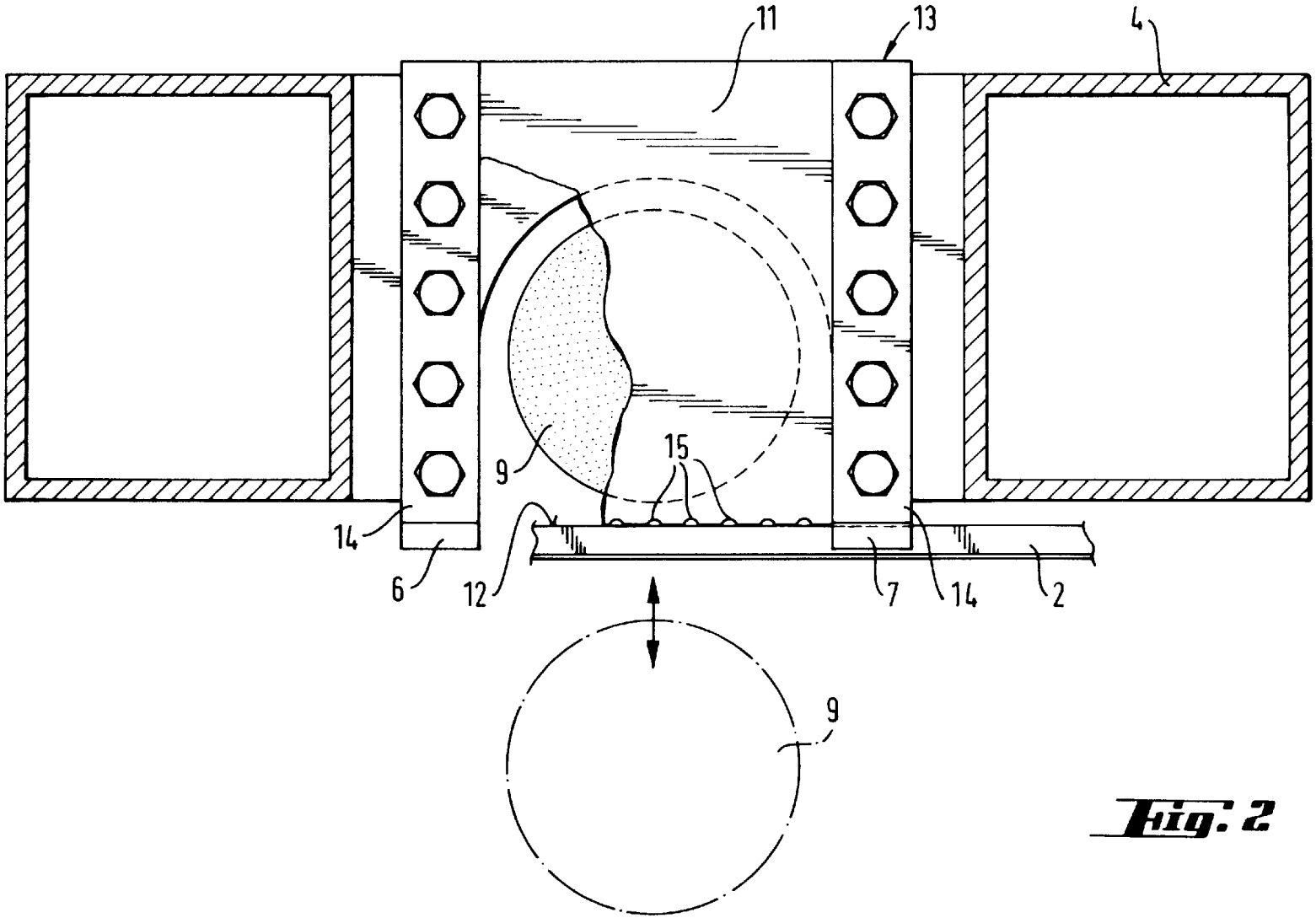
FIG. 2 shows a plan view of a horizontal cross section along line 2—2 of FIG. 1; for the sake of clarity, only part of the support plate and the sawband are shown in the left-hand half of FIG. 2.

FIG. 2 shows the workpiece in two different positions, namely before and after a wafer has been sliced off from the workpiece. According to the invention, FIG. 2 shows a support plate 11, which supports by contacting the band back 12, and is arranged behind the sawband, in the direction of feed. This prevents the sawband from bending during the cutting operation. The support plate is preferably attached to the side arms 14 of a holding device 13. The holding device can be adjusted using the machine frame 4 and, if appropriate, can be connected so that it can move in a controlled manner. The support plate is preferably held in the holding device in a preloaded manner, so that its planarity is ensured during the cutting operation. The preloading is advantageously set when mounting the support plate by tensioning the side arms 14 of the holding device 13 before attaching the support plate. The guides 6 and 7 are preferably attached to the holding device as well.

Since the sawband 2 slides along the support plate 11 during the cutting operation, a lubricating film can be present between the support plate and the band back. The lubricant, for example can be a graphite paste, which may be applied to the band back before the sawband enters into the workpiece. The support plate is made entirely or partially from a material which is preferably selected from a group comprising steel or other metals such as gray iron, or from graphite, or from plastic or can be a composite material.

The support plate may be divided up into component parts having differing material properties. This is to enable the support plate to conform to the cutting requirements. It is preferred for at least the base body of the support plate to be made from sheet metal, in particular from high-strength steel sheet.

Figure 3:
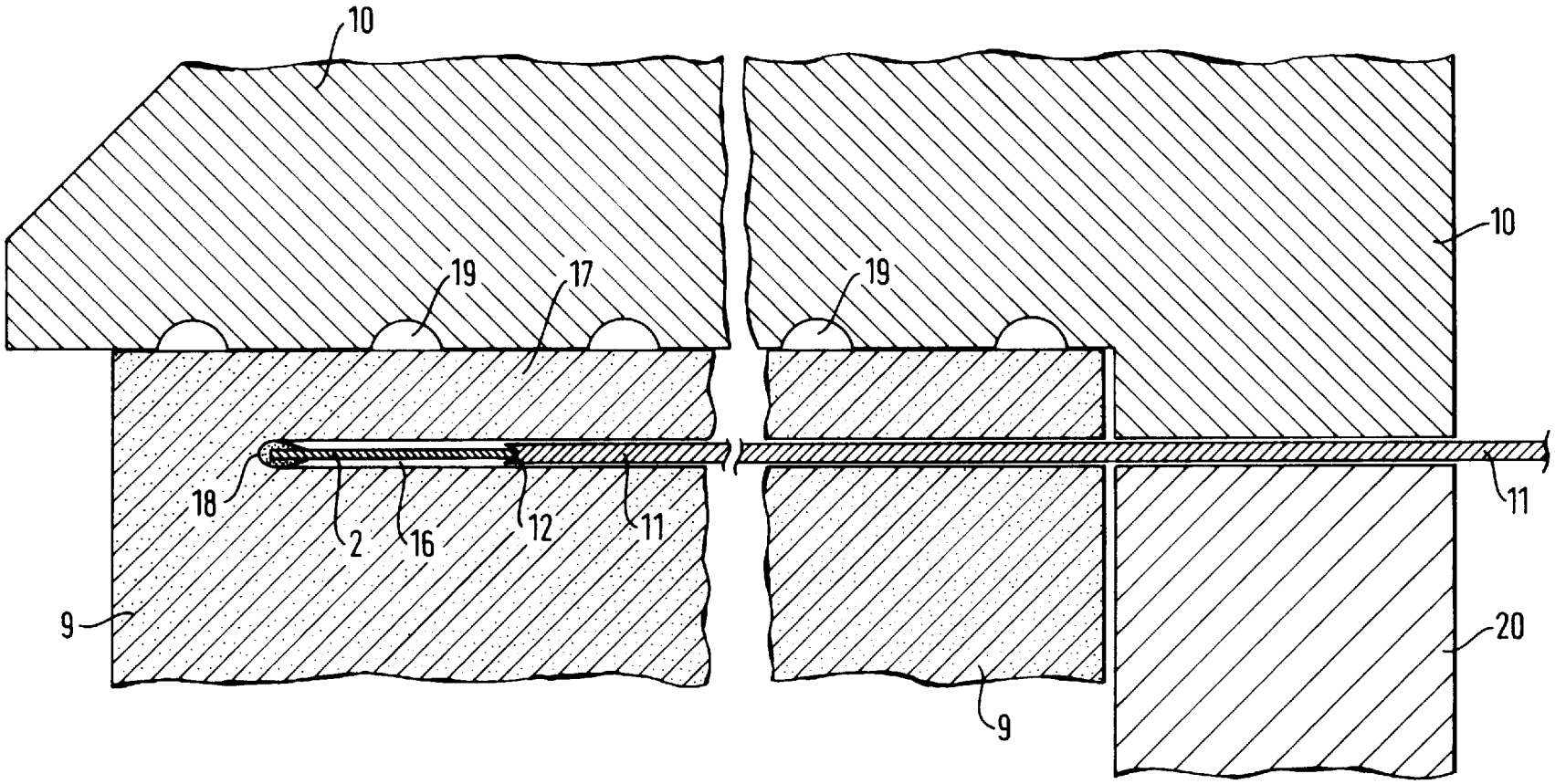
FIG. 3 shows a vertical cross section through the workpiece during the cutting operation.

It is particularly preferred in FIG. 3 for the surface 22 of the band back 12 bearing against the support plate 11 to be of convex shape. Also it is desirable for the surface of the support plate 11 bearing against the band back 12 to be of concave shape. The band back consequently runs in a guide. The guidance of the sawband on the support plate may additionally or alternatively also be improved by applying chamfers to that surface of the support plate 11 which bears against the band back. Particularly preferred are chamfers which alternate over the length of the guide, so that the band back is alternately guided from above and below (not shown).

Furthermore, as shown in FIG. 2, the support plate may be interrupted by recesses 15, through which it is possible to supply lubricant to the surfaces of the support plate and the band back which slide along one another. It may also be advantageous for there to be openings in the support plate for the purpose of guiding the sawband. The length over which the support plate and the band back slide along one another can be selected as desired and depends essentially on the width of the support plate. It is most effective for the sawband to be supported in the central region between the guides 6 and 7. It is preferable for this length to encompass that part of the band back which penetrates into the workpiece. The width of the support plate (in the feed direction) is not limited according to the invention, so that it is possible to achieve a very high rigidity. However, the support plate may also comprise a narrow, high-strength strip.

The amount of friction is minimized if the sawband is supported on a surface of ice. To achieve this result, it is possible to provide the wafer holder with a cooling device, so that water fed to the cutting gap freezes and forms a layer of ice on the support plate. The layer of ice on the support plate can be prevented from growing into the cutting gap by means of oscillating movements and by means of a very smooth surface on the support plate.

The wafer holder 10 can also be used to guide the support plate 11 before and during its penetration into the cutting gap. For this purpose, the wafer holder is of an enlarged construction, so that it covers the wafer and part of the sawband and part of the support plate. That part of the wafer holder which guides the support plate is in this case extended downward by the thickness of the plate and forms a guide surface facing towards the support plate (FIG. 3). The support plate may additionally be guided from the side opposite to the sawband. A guide 20 which can be moved under the support plate is provided for this purpose. This manner of guidance of the support plate is advantageous particularly during the initial or starting cutting phase.

FIG. 3 shows a cross-sectional view of the sawband 2, which is already situated within a cutting gap 16 and is cutting off a wafer 17 from the workpiece 9. The back 12 of the sawband is supported by the support plate 11. On that side of the sawband 2 which is situated opposite to the band back 12 is located a cutting edge 18 which is provided with a cutting surface. The wafer holder 10, which is provided with suction openings 19, and the cutting gap 16 together form guide surfaces for guiding the support plate 11 and the sawband 2. There are no limits on the shape of the cross-section of the band. However, widening the sawband in the region of the band back has advantageous effects on the guidance of the sawband. As previously mentioned, the guides arranged on both sides of the workpiece can also be used to guide and control the band path.

However, precise control and correction of the band path in the cutting gap is preferably brought about by moving the workpiece or by applying a fluid stream to the support plate and/or to the sawband in the cutting gap. As soon as any deviation from a desired cutting path is detected, this deviation is corrected by means of a compensatory movement of the workpiece. This deviation can also be corrected by applying the fluid stream to the top or to the bottom of the support plate and/or of the sawband. The band back is in this case held by the support plate, so that the cutting edge is moved relative to the band back.

A particular advantage that results by using the support plate is that the support plate can exert an oscillating movement on the sawband in the feed direction. Hence, the sawband cutting power is also further improved. To this end, the holding device with the support plate is mounted in such a way that it is movable in the feed direction, and an oscillating drive means is attached to the holding device.

The holding device 13 and the lateral sliding guides 6 and 7 may be arranged on the machine frame 4, as shown in FIGS. 1 and 2. The holding device 13 may be shaped in such a way that a wafer which has been cut off can be removed along the support plate. This is illustrated in FIG. 2. It is also possible to remove wafers by crossing over the sawband.

To produce a band bearing the cutting edge 18, by way of example, a band loop is made into the desired shape by cold rolling. Alternatively, a strip is rolled down to the desired circumference to form a band loop and is then remachined to the desired thickness and shape, generally by grinding. A suitable band loop can also be produced by welding together a finite strip, optionally with subsequent machining, for example by grinding. The requirements placed on the rigidity of the sawband are reduced considerably by the support arrangement according to the invention.

The support plate supports the band back of the sawband, thus preventing disadvantageous bending of the sawband during the cutting operation. During the cutting operation, that part of the support plate which adjoins the band back penetrates into the cutting gap.

It is preferred to start cutting off a wafer from a workpiece by grinding over the end of the workpiece using a grinding device (not shown) which is optionally combined with the bandsaw. The workpiece is then moved to the cutting edge of the sawband using the feed device. In this phase, the wafer holder is connected to the workpiece. It is preferred to couple together the subsequent common movement of workpiece and wafer holder. During the subsequent cutting operation, the cutting surface of the sawband produces the cutting gap. The cutting gap accommodates the support plate. In the phase in which the support plate is not yet being guided in the cutting gap, the wafer holder, which is of an enlarged construction, acts as a guide for the top of the sawband. At this time, guidance can be temporarily applied to the bottom of the sawband, by using the support plate. After the cutting is complete, the wafer which has been sliced off is removed from the support plate. In this case, the wafer can advantageously be moved by using the wafer holder. The workpiece is moved back into the initial position and advanced upward for the next cutting operation.

The support of the band back within the cutting gap makes it possible to use very narrow bands, and even down to wires with a coating on one side. The cross-sectional thickness of the sawband may be selected within wide ranges. Cross-sectional thicknesses of 20 $\mu$m to 400 $\mu$m, in particular from 50 $\mu$m to 100 $\mu$m, are preferred for the production of semiconductor wafers.

According to a preferred embodiment of the process, it is possible to provide for a pivoting movement of the workpiece or for a pivoting movement of the deflection pulleys to be superimposed on the feed movement during the cutting operation. This pivoting movement is carried out about an axis which is essentially perpendicular to the cutting plane and has the objective of shortening the length of engagement between sawband and workpiece. As is clear from the description of FR 1,569,176, this pivoting movement may also be of oscillating form. The disclosure of FR 1,569,176 is herewith incorporated by reference.

The length of engagement is to be understood as meaning the length of the cutting edge provided with a cutting surface which is in contact with the workpiece at that particular time. Without a pivoting movement, the length of engagement increases during the cutting of a wafer up to a length which corresponds to the diameter of the workpiece, and falls again accordingly until the wafer has been cut off. It is preferred to use this superimposed pivoting movement to ensure that the maximum possible length of engagement in each case is not reached, preferably by at least 30%. If the length of engagement is kept at a low level in this way, the contact time is reduced for those diamond grains of the cutting surface which are in contact with the workpiece. This facilitates the removal of the slurry produced. The speed of the feed movement may be adapted to the cutting operation and can be increased accordingly with the improved cutting and slurry-removal conditions. It is preferred for the feed rate not to be constant, but rather to be adapted to the conditions during cutting and removal of the slurry produced.

While several embodiments of the present invention have been shown and described, it is to be understood that many changes and modifications may be made thereunto without departing from the spirit and scope of the invention as defined in the appended claims.

What is claimed is:

1. A bandsaw for cutting off slices from a workpiece, said workpiece having sides comprising a system of pulleys;

a sawband which circulates over said system of pulleys, said sawband having a band back and a cutting edge, which cutting edge is situated opposite to the band back and is provided with a cutting surface;

a feed system for effecting a relative movement between said workpiece and the cutting edge to produce a cutting gap having a width and formed by the sawband penetrating into the workpiece;

a support plate for supporting by contacting the band back of the sawband while penetrating into the cutting gap; and said support plate preventing the sawband from bending throughout said cutting;

a holding device for holding the support plate; and a wafer holder with means for guiding the support plate.

2. The bandsaw as claimed in claim 1, wherein the support plate comprises a material which is selected from a group consisting of steel, gray iron, other metals, graphite, plastic and composite material.

3. The bandsaw as claimed in claim 1, comprising means for preloading the support plate into the holding device.

4. The bandsaw as claimed in claim 1, further comprising guides for guiding the sawband at the sides of the workpiece; and wherein the holding device is connected to said guides.

5. The bandsaw as claimed in claim 1, wherein the sawband has a cross-sectional thickness ranging from 20 $\mu$m to 400 $\mu$m.

6. The bandsaw as claimed in claim 5, wherein the cross-sectional thickness of the sawband increases in a region of the band back and in said region approximately reaches the width of the cutting gap.

7. The bandsaw as claimed in claim 1, wherein the support plate, on a side facing the band back, has a concave shape.

8. The bandsaw as claimed in claim 1, wherein the support plate, on a side facing the band back, has chamfers.

9. The bandsaw as claimed in claim 1, wherein the system of pulleys comprises deflection pulleys with each pulley having an axis and the axes of the pulleys are vertically aligned.

10. The bandsaw as claimed in claim 1, wherein the system of pulleys comprises deflection pulleys with each pulley having an axis and the axes of the pulleys are vertically inclined.

11. A process for cutting off slices of semiconductor material from a workpiece using a bandsaw with a circulating sawband, said sawband having a band back and a cutting edge with a cutting surface comprising the steps of circulating said sawband in said bandsaw to cause said cutting edge to penetrate into said workpiece so as to cut a cutting gap within said workpiece;

supporting the circulating sawband on its band back by a support plate contacting the band back, and said support plate preventing the sawband from bending throughout said cutting;

maintaining a part of the support plate which part is supporting the band back, also penetrating into the cutting gap; and guiding the support plate by a wafer holder having means for guiding the support plate.

12. The process as claimed in claim 11, comprising supporting a wafer to be cut off from the workpiece by using the wafer holder.

13. The process as claimed in claim 11, comprising correcting a deviation from a planar cutting path by means of a relative movement between the support plate and the workpiece.

14. The process as claimed in claim 11, comprising applying a fluid stream in the cutting gap to act on the support plate for controlling a cutting path of the sawband.

15. The process as claimed in claim 11, comprising applying a fluid stream in the cutting gap to act on the sawband for controlling a cutting path of the sawband.

16. The process as claimed in claim 11, comprising applying a fluid stream in the cutting gap to act on the support plate and on the sawband for controlling a cutting path of the sawband.

17. The process as claimed in claim 11, comprising lubricating the sawband in a region of the band back before the cutting edge is penetrating into the workpiece.

18. The process as claimed in claim 11, comprising providing the support plate with oscillating movements during the cutting of the workpiece.

19. The process as claimed in claim 11, comprising providing a length of engagement between the cutting edge having the cutting surface and the workpiece, which length of engagement is less than a maximum length of engagement.

20. The process as claimed in claim 11, comprising providing a feed rate for the workpiece which is variable during cutting and removing slurry produced.

21. In a bandsaw for cutting off slices from a workpiece, and said workpiece having sides, said bandsaw having a system of pulleys, a sawband which circulates over said system of pulleys, said sawband having a band back, and a cutting edge situated opposite to the band back and provided with a cutting surface, a feed system for effecting a relative movement between said workpiece and the cutting edge to produce a cutting gap having a width and formed by the sawband penetrating into the workpiece;

the improvement comprising:

a support plate for supporting the band back of the sawband while penetrating into the cutting gap;

a holding device for holding the support plate; and a wafer holder with means for guiding the support plate.

* * * * *